United States Patent [19]

Miyakawa et al.

[11] 4,142,165

[45] Feb. 27, 1979

[54] ELECTROSTATIC COPYING MACHINE COMPRISING IMPROVED MAGNETIC BRUSH DEVELOPING-CLEANING UNIT

[75] Inventors: Seiichi Miyakawa; Takashi Yano, both of Tokyo, Japan

[73] Assignee: Ricoh Company, Ltd., Tokyo, Japan

[21] Appl. No.: 780,223

[22] Filed: Mar. 22, 1977

[30] Foreign Application Priority Data

Mar. 25, 1976 [JP] Japan ..... 51-32939
Apr. 13, 1976 [JP] Japan ..... 51-41470

[51] Int. Cl.[2] ..... G03G 15/09; G03G 21/00

[52] U.S. Cl. ..... 355/14; 118/652; 118/657; 355/3 DD; 355/15

[58] Field of Search ..... 355/3 R, 3 DD, 15, 14; 118/652, 657, 658

[56] References Cited

U.S. PATENT DOCUMENTS

| | | | |
|---|---|---|---|
| 3,580,673 | 5/1971 | Yang | 355/15 |
| 3,848,994 | 11/1974 | Fraser | 355/15 |
| 3,914,045 | 10/1975 | Namiki et al. | 355/15 |
| 3,932,034 | 1/1976 | Takahashi | 355/3 DD |
| 3,981,268 | 9/1976 | Tsukamoto et al. | 118/657 X |

*Primary Examiner*—Fred L. Braun
*Attorney, Agent, or Firm*—David G. Alexander

[57] ABSTRACT

A magnetic brush is used to develop a toner image on a photoconductive drum and subsequently to remove residual toner substance from the drum. An electrode roller is disposed closely adjacent to the magnetic brush between a developing tank containing the toner substance and the drum in the direction of rotation of the magnetic brush. For cleaning the drum, an electric potential is applied between the magnetic brush and the electrode roller which causes toner substance to be transferred from the magnetic brush to the electrode roller, thereby reducing the amount of toner substance on the magnetic brush and improving the cleaning effect. For development, the electric potential may be reversed to transfer the toner substance from the electrode roller back to the magnetic brush to increase theamount of toner substance thereon. Alternatively, the toner substance may be removed from the electrode roller for recycling and no transfer effected between the magnetic brush and the electrode roller during development. As yet another alternative, the electric potential may be varied during development in accordance with sensed image density on the drum to transfer toner substance from the magnetic brush to the electrode roller in a suitable amount to adjust the printing density to a desired value.

13 Claims, 4 Drawing Figures

ELECTROSTATIC COPYING MACHINE COMPRISING IMPROVED MAGNETIC BRUSH DEVELOPING-CLEANING UNIT

BACKGROUND OF THE INVENTION

The present invention relates to an electrostatic copying machine comprising an improved magnetic brush developing-cleaning unit.

In a typical electrostatic copying machine, a photoconductive drum is electrostatically charged and radiated with a light image of an original document to form an electrostatic image on the drum through localized photoconduction. A magnetic brush applies a developing or toner substance to the drum to develop the electrostatic image into a toner image, which is transferred and fixed to a copy sheet to provide a permanent reproduction. Thereafter, the magnetic brush is used again to clean residual toner substance from the drum in preparation for another copying operation.

The magnetic brush comprises a non-magnetic rotary sleeve in which are coaxially disposed one or more magnets. The lower portion of the sleeve is immersed in a developing tank containing the toner substance and the upper portion of the sleeve is disposed closely adjacent to the drum. Upon relative rotation of the drum and sleeve, toner substance is magnetically attracted and adheres to the rotating sleeve to form a rotating brush thereon comprised of particles of toner substance.

In the prior art, a bias potential is applied to the magnetic brush during development which is sufficient to prevent toner substance from being attracted to the white image areas of the electrostatic image and prevent these areas from printing gray. During cleaning, the bias voltage is increased to attract all residual toner substance from the drum onto the magnetic brush. This prior art system is disadvantageous in that it does not afford sufficient control over the density of the developed toner image and does not sufficiently clean the drum. This is because the same uncontrolled amount of toner substance is present on the magnetic brush during both development and cleaning.

SUMMARY OF THE INVENTION

In accordance with the present invention, a magnetic brush applies a toner substance to a photoconductive drum having an electrostatic image of an original document formed on the periphery thereof. The toner substance develops the electrostatic image to form a toner image which is transferred to a copy sheet to provide a permanent reproduction. Subsequently, the magnetic brush is used again to clean residual toner substance from the drum in preparation for another copying operation. An electrode roller is disposed closely adjacent to the magnetic brush between a developing tank containing the toner substance and the drum in the direction of rotation of the magnetic brush. For cleaning the drum, an electric potential is applied between the magnetic brush and the electrode roller which causes toner substance to be transferred from the magnetic brush to the electrode roller, thereby reducing the amount of toner substance on the magnetic brush and improving the cleaning effect. In one form of the invention the electric potential is reversed to transfer the toner substance from the electrode roller back to the magnetic brush to increase the amount of toner substance thereon. In another form of the invention, the toner substance is removed from the electrode roller for recycling and no transfer effected between the magnetic brush and the electrode roller. In yet another form of the invention, the electric potential is varied during development in accordance with sensed image density on the drum to transfer toner substance from the magnetic brush to the electrode roller in an amount to adjust the printing density to a desired value.

It is an object of the present invention to provide an electrostatic copying machine comprising an improved magnetic brush developing-cleaning unit which provides increased cleaning efficiency.

It is another object of the present invention to provide a copying machine comprising means for optimally adjusting the printing density in an improved manner.

It is another object of the present invention to provide a copying machine comprising means for replenishing toner substance in an improved manner.

It is another object of the present invention to provide a generally improved electrostatic copying machine.

Other objects, together with the foregoing, are attained in the embodiments described in the following description and illustrated in the accompanying drawing.

DESCRIPTION OF THE PREFERRED EMBODIMENTS

While the electrostatic copying machine of the invention is susceptible of numerous physical embodiments, depending upon the environment and requirements of use, substantial numbers of the herein shown and described embodiments have been made, tested and used, and all have performed in an eminently satisfactory manner.

Figure 1:
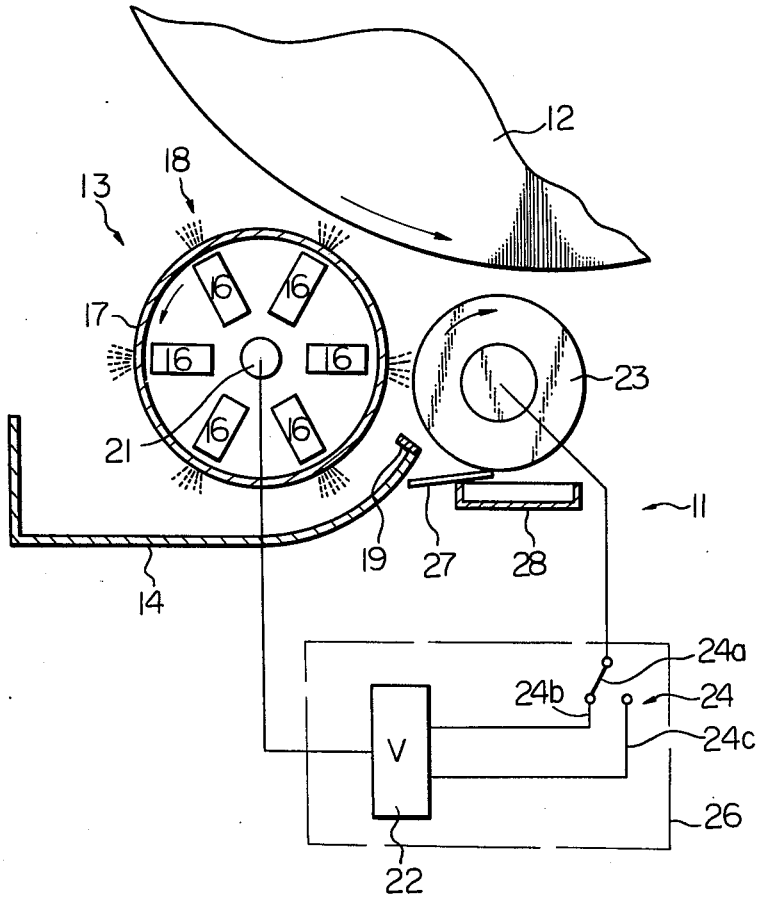
FIG. 1 is a schematic view of a first embodiment of an electrostatic copying machine according to the present invention.

Referring now to FIG. 1 of the drawing, an electrostatic copying machine embodying the present invention is generally designated as 11 and comprises a rotary photoconductive drum 12 which is driven for counterclockwise rotation at constant speed. The drum 12 is formed of a grounded metal core on the periphery of which is formed a photoconductive layer of, for example, selenium. Although not shown, a charging unit applies an electrostatic charge to the periphery of the drum 12. Thereafter, an exposure unit, which is likewise not shown, radiates a light image of an original document onto the drum 12 to form an electrostatic image thereon through localized photoconduction. A developing unit 13 applies a developing or toner substance to the drum 12 to develop the electrostatic image into a toner image. The toner substance adheres to the areas of the electrostatic image which retain a high electrostatic charge, or the dark image areas. Thereafter, the tone image is transferred and fixed to a copy sheet by means not shown to provide a permanent reproduction of the original document. During a second revolution of the drum 12, the developing unit 13 is used to clean residual toner substance from the periphery of the drum 12.

The developing unit 13 comprises a developing tank 14 into which the toner substance is supplied. A plurality of magnets 16 are fixedly mounted as shown above the developing tank 14. Coaxially surrounding the magnets 16 is a cylindrical sleeve 17 made of a non-magnetic material which is immersed at its lower portion in the toner substance in the developing tank 14.

The upper portion of the sleeve 17 is disposed closely adjacent to the drum 12 and is coextensive therewith in length. The sleeve 17 is driven for counterclockwise rotation at constant speed. Due to the attraction of the magnets 16 within the sleeve 17, the toner substance is attracted and adheres to the periphery of the sleeve 17 to form a rotating magnetic brush which is designated as 18. More specifically, the magnetic brush 18 is comprised of particles of the toner substance which adheres to the sleeve 17 and rotates therewith. A doctor blade 19 is provided on the developing tank 14 to limit the thickness of the magnetic brush 18 to a predetermined value. The clearance between the sleeve 17 and drum 12 is selected so that the magnetic brush 18 brushingly engages with the drum 12 upon rotation thereof during development, so that toner substance is attracted from the magnetic brush 18 to the electrostatic image on the drum 12 to form the toner image on the drum 12. For drum cleaning, the drum 12 is first discharged by means which are not shown and residual toner substance is removed from the drum 12 by the magnetic brush 18 through brushing friction and electrostatic attraction, with the residual toner substance which is removed becoming part of the magnetic brush 18.

Typically, the toner substance comprises magnetic carrier particles about 200 microns in diameter and resinous toner particles about 10 to 20 microns in diameter. The carrier particles are magnetically attracted onto the sleeve 17 carrying the toner particles therewith to form the magnetic brush 18. The toner particles are attracted and transferred to the electrostatic image on the drum 12 by electrostatic induction.

In accordance with the present invention, an electrode 21 is disposed inside the sleeve 17 and connected to a voltage source 22, which applies an electric potential to the sleeve 17 and thereby to the magnetic brush 18 suitable for developing or cleaning. A rotary cylinder or electrode roller 23 is disposed adjacent to the sleeve 17 between the developing tank 14 and the drum 12 in the direction of rotation of the sleeve 17. The electrode roller 23 is driven for clockwise rotation at constant speed.

Furthermore, the electrode roller 23 is connected to the voltage source 22 through a single-pole, double-throw switch 24, with the switch 24 and voltage source 22 being part of a control unit 26 for controlling an electric potential between the magnetic brush 18 and electrode roller 23. The switch 24 has a movable contact 24*a* which is selectively connected to fixed contacts 24*b* and 24*c* which lead to different voltage output terminals (not designated) of the voltage source 22.

To utilize the magnetic brush 18 for cleaning the drum 12, the control unit 26 is actuated by switches, cams or the like (not shown) of the copying machine 11 to connect the movable contact 24*a* to the fixed contact 24*b*, whereby the electric potential between the magnetic brush 18 and electrode roller 23 is set in such a manner that a predetermined amount of toner substance is transferred from the magnetic brush 18 to the electrode roller 23. This reduces the thickness of the magnetic brush 18 and improves the cleaning efficiency since too much toner substance on the magnetic brush 18 impedes the transfer of toner substance form the drum 12 to the magnetic brush 18.

In the embodiment of FIG. 1, a scraper 27 is provided above a container 28 which scrapes the toner substance from the electrode roller 23 and causes it to fall into the container 28. Preferably, the toner substance in the container 28 is returned to the developing tank 14 for recycling, although the connection is not shown. In this manner, excess toner substance which would interfere with the cleaning operation is removed from the magnetic brush 18 by means of the electrode roller 23.

For developing, it is desirable to have more toner substance on the magnetic brush 18 than is suitable for cleaning. Thus, when the developing unit 13 is to be used for development, the switch 24 is changed over so that the movable contact 24*a* engages with the fixed contact 24*c*, thereby removing the electric potential between the magnetic brush 18 and electrode roller 23 which causes the toner substance to be transferred from the magnetic brush 23 to the electrode roller 18. The contact 24*c* may be maintained at ground potential or any other suitable potential which eliminates the toner transfer effect. Thus, for development, the sleeve 17 picks up toner substance from the developing tank 14 without the influence of the electrode roller 23, thereby making the magnetic brush 18 thicker for development.

Figure 2:
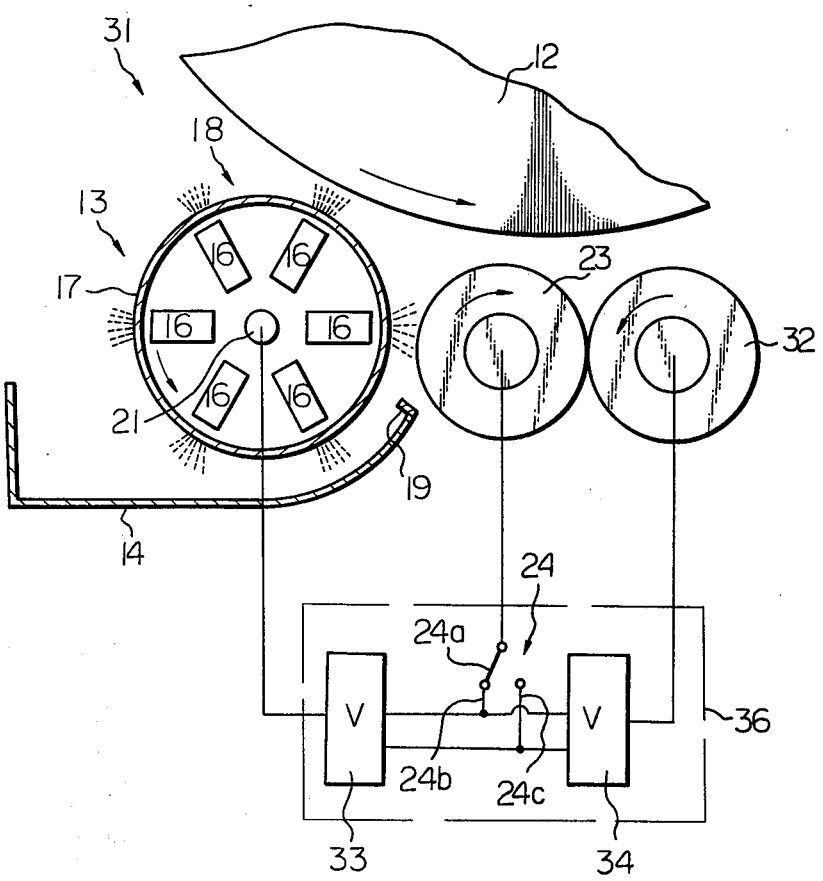
FIG. 2 is similar to FIG. 1 but shows a second embodiment.

FIG. 2 shows another copying machine 31 embodying the present invention, in which like elements are designated by the same reference numerals used in FIG. 1. The copying machine 31 comprises an auxiliary rotary cylinder or electrode roller 32 which is driven for counterclockwise rotation at constant speed in contact with the electrode roller 23. In the copying machine 31, the scraper 27 and container 28 are not used.

The voltage source 22 is replaced by a voltage source 33 connected to the electrode 21 and also to the fixed contacts 24*b* and 24*c* of the switch 24. In addition, a voltage source 34 is connected to the auxiliary electrode roller 32 and also to the contacts 24*b* and 24*c* of the switch 24.

For cleaning, the movable contact 24*a* is connected to the fixed contact 24*b* in the same manner as above, and the electric potential of the voltage source 33 causes toner transfer from the magnetic brush 18 to the electrode roller 23 to reduce the amount of toner substance on the magnetic brush 18. The voltage source 34 is arranged to apply an electric potential between the auxiliary electrode roller 32 and the electrode roller 23 such that the toner substance removed from the magnetic brush 18 by the electrode roller 23 is transferred from the electrode roller 23 to the auxiliary electrode roller 32 and accumulates thereon.

For development, the switch 24 is changed over. In this case, the voltage source 34 changes the electric potential between the auxiliary electrode roller 32 and the electrode roller 23 so that the toner substance is transferred back from the auxiliary electrode roller 32 to the electrode roller 23. In addition, the voltage source 33 changes the electric potential between the electrode roller 23 and the magnetic brush 18 so that the toner substance is transferred from the electrode roller 23 back to the magnetic brush 18 thereby increasing the amount of toner substance thereon. In this manner, the toner substance removed from the magnetic brush 18 for cleaning is returned thereto for developing, thereby ensuring that there will be sufficient toner substance on the magnetic brush 18 to produce copies of normal density.

By properly selecting the diameters and rotational speeds of the drum 12, magnetic brush 18 and electrode roller 23, the auxiliary roller 32 may be omitted but the same effect may be obtained. Specifically, the rotational speeds of the electrode roller 23 and drum 12 should be the same. During cleaning, the toner substance will be transferred to the electrode roller 23 during one revolution of the drum 12 and electrode roller 23. At the commencement of the subsequent development, the leading edge of the toner substance on the electrode roller 23 will align with the magnetic brush 18 so that the toner substance will be transferred back to the magnetic brush 18 at just the right timing.

Figure 3:
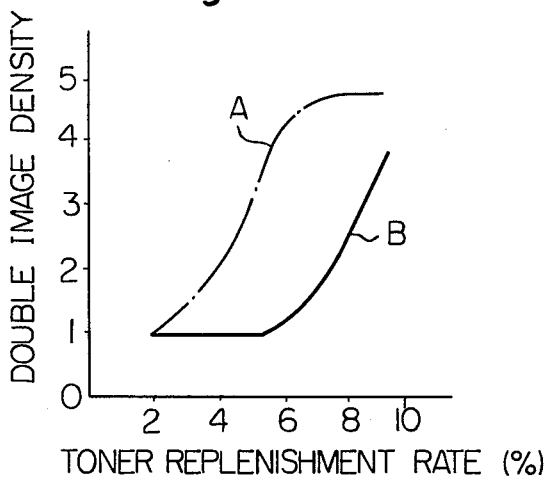
FIG. 3 is a graph illustrating the improved cleaning efficiency of the present invention over the prior art.

FIG. 3 illustrates the cleaning efficiency of the embodiments of FIGS. 1 and 2 compared to the prior art, where the abcissa axis represents the toner replenishment rate in percent over a predetermined time and the ordinate axis represents the double image density on a comparative scale of "0" to "5". Where the drum 12 is cleaned insufficiently so that not all of the residual toner substance is removed therefrom, a double image (double printing) of a previous document will appear superimposed on the image of a subsequent document. In other words, the image of the previous document was not completely removed from the drum 12 during the cleaning operation. In FIG. 3, the double image is just visible at relative density "1" and is so clear at relative density "5" that the copy is unacceptable.

A broken line curve "A" represents the performance of a typical prior art copying machine. It will be noted that unacceptable copies are produced at a toner repenishment rate of only 6%. This may even preclude the possibility of producing acceptable copies since if the toner replenishment rate is decreased to eliminate the double images the overall density of the copies may be reduced below an unacceptable level.

A solid line curve "B" represents the performance of the present invention. It will be seen that at a toner replenishment rate of 6% the double image density is still substantially "1", and that the toner replenishment rate may be increased to over 10% before unacceptable copies are produced. For obtaining the curve "B", the average electrostatic potential of the image on the drum 12 was about 600V, the electric potential between the magnetic brush 18 and the electrode roller 23 was 200V and the average thickness of the magnetic brush 18 was 3mm.

In prior art copying machines toner is fed into the developing tank at predetermined intervals for replenishment. The replenishment rate is selected to maintain the printing density constant. However, it is difficult with such an arrangement to maintain constant density since the rate of toner consumption fluctuates. If sensing means are provided to sense the consumption rate and adjust the replenishment rate accordingly, an excessive time is required for adjustment since a change in replenishment rate does not have an immediate effect on density. Thus, a number of copies of less than optimum quality are produced while the adjustment is being effected.

Figure 4:
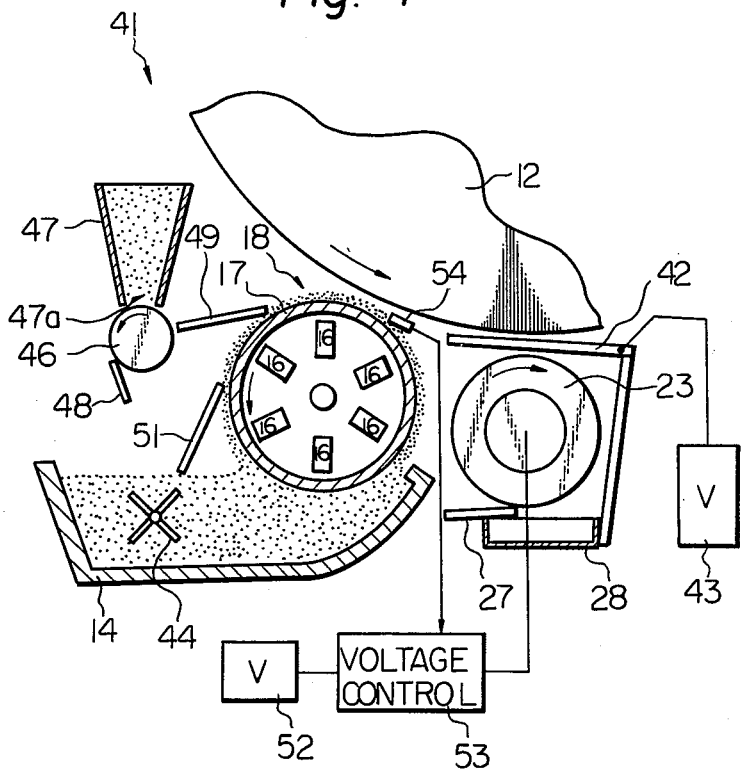
FIG. 4 is also similar to FIG. 1 but shows a third embodiment of the present invention.

The embodiment of the present invention shown in FIG. 4 is specially designed to overcome this problem. A copying machine 41 comprises elements common to the embodiment of FIG. 1 with the same reference numerals being used. The copying machine 41 comprises, in addition, a shield 42 disposed between the electrode roller 23 and drum 12 to prevent the electrostatic image on the drum 12 from being effected by the potential applied to the electrode roller 23. The shield 42 may be grounded or charged to an appropriate potential by a voltage source 43. Also shown is an agitator 44 provided in the developing tank 14 to homogenize the toner substance therein.

A magnetic rotary cylinder or mixing roller 46 is disposed above the developing tank 14 between the drum 12 and the developing tank 14 in the direction of rotation of the magnetic brush 18. A supply hopper 47 which is filled with fresh toner substance is disposed above the mixing roller 46 with a supply orifice **47*a* of the hopper 47 directly above the mixing roller 46. Fresh toner substance falls onto the mixing roller 46 from the hopper 47 at a substantially constant rate and falls from the mixing roller 46 into the developing tank 14**.

The mixing roller 46 is rotated counterclockwise at constant speed and a scraper blade 48 is disposed below the mixing roller 46 in scraping engagement therewith to remove any adhered toner substance therefrom and cause the same to fall into the developing tank 14. In addition, a doctor blade 49 is operatively disposed adjacent to the magnetic brush 18 and mixing roller 46. The distance between the doctor blade 49 and the sleeve 17 is selected so that a predetermined amount of toner substance is removed from the magnetic brush 18 by the doctor blade 49 and conveyed thereby onto the mixing roller 46. The toner substance removed from the magnetic brush 18 is mixed with the fresh toner substance from the hopper 47 and caused to fall from the mixing roller 46 into the developing tank 14. A scraper blade 51 provided adjacent to the sleeve 17 removes all remaining toner substance therefrom subsequent to the action of the doctor blade 49 and causes the same to fall into the developing tank 14. It will be seen that this arrangement provides improved homogeneity of toner substance and removes all toner substance from the sleeve 17 prior to immersion in the developing tank 14. Thus, a new magnetic brush 18 is formed for each operation.

The copying machine 41 further comprises a voltage source 52 and a voltage control unit 53 which is connected between the voltage source 52 and the electrode roller 23. During cleaning, the electric potential applied to the electrode roller 23 is adjusted so as to remove a predetermined amount of toner substance from the magnetic brush 18 in the same manner as in the copying machine 11 of FIG. 1. However, during development, the voltage control unit 53 causes an electric potential to be applied to the electrode roller 23 which causes a smaller amount of toner substance to be transferred from the magnetic brush 18 to the electrode roller 23. The amount of toner transfer determines the printing density and affords a very effective means of control thereof. More specifically, the more toner substance removed from the magnetic brush 18 by the electrode roller 23 the lower the printing density.

The control unit 53 may comprise a potentiometer (not shown) which is manually adjusted in response to a visual evaluation of the printing density. However, the control unit 53 more preferably comprises an electronic control circuit utilizing operational amplifiers or the like (not shown) which is responsive to the output of a sensor 54 provided adjacent to the drum 12 to sense the density of the toner image thereon. The control unit 53 adjust the electric potential applied to the electrode roller 23 and thereby the printing density in response to the output of the sensor 54 to automatically maintain the printing density at the desired predetermined value.

Although the detailed construction of the sensor 54 is not the subject matter of the present invention and is not shown, the sensor 54 may comprise a light source to illuminate a margin or non-image area on the drum 12 which is not exposed but is developed. In such an area, the density of the toner image will be maximum. In this case the sensor 54 will comprise a photosensitive element which receives the light from the light source after reflection from the illuminated area of the drum 12. The electric output of the photosensitive element corresponds to the amount of reflected light and thereby the density of the toner image.

It will be understood that the arrangement of FIG. 4 constitutes a closed loop servo control system with very fast response time compared to the prior art.

In summary, it will be seen that the present invention provides a copying machine in which the drum cleaning operation is much more efficient than in the prior art. Also, the present invention improves the control of image density to a large extent by means of an electric potential applied to an electrode during development which adjusts the thickness of a magnetic brush of a developing unit.

Many modifications to the particular embodiments shown are possible for those skilled in the art without departing from the scope of the present disclosure. The various cylindrical members may be replaced by endless rotary belts. In the embodiment of FIG. 2 separate means may be provided for removing toner substance from the electrode roller 23 and applying toner substance thereto. As yet another modification, during development, toner substance may be transferred from the electrode roller 23 to the magnetic brush 18 without the need of an electric potential therebetween due to the frictional brushing effect of the magnetic brush 18 on the electrode roller 23.

What is claimed is:

1. An electrostatic copying machine comprising:

a rotary photoconductive member;

a magnetic brush developing unit including a rotary magnetic brush operatively disposed adjacent to the photoconductive member and a developing tank containing a toner substance in which the magnetic brush is partially immersed, the magnetic brush being arranged to develop a toner image on the photoconductive member by applying toner substance thereto and to clean the photoconductive member by removing toner subtance therefrom;

an electrode disposed closely adjacent to the magnetic brush between the developing tank and the photoconductive member in a direction of rotation of the magnetic brush; and a voltage source for applying an electric potential between the magnetic brush and the electrode for controlling an amount of transfer of toner substance therebetween, the voltage source being constructed to vary the electric potential in such a manner that a predetermind portion of the toner substance is transferred from the magnetic brush to the electrode when the developing unit is being used for cleaning the photoconductive member.

2. A copying machine as in claim 1, in which the electrode comprises a rotary cylinder.

3. A copying machine as in claim 1, further comprising means for removing toner substance from the electrode.

4. A copying machine as in claim 1 in which the voltage source is constructed to vary the electric potential in such a manner that toner substance is transferred from the electrode to the magnetic brush only when the developing unit is being used for developing a toner image on the photoconductive member.

5. A copying machine as in claim 4, in which the voltage source comprises switch mens for switchingly varying the electric potential.

6. A copying machine as in claim 4, in which diameters and rotational speeds of the photoconductive member, magnetic brush and electrode are selected in such a manner that toner substance transferred from the magnetic brush to the electrode when the developing unit is being used for cleaning the photoconductive member aligns with and is transferred back to the magnetic brush when the developing unit is subsequently being used for developing a toner image on the photoconductive member.

7. An electrostatic copying machine comprising:

a rotary photoconductive member;

a magnetic brush developing unit including a rotary magnetic brush operatively disposed adjacent to the photoconductive member and a developing tank containing a toner substance in which the magnetic brush is partially immersed;

an electrode disposed closely adjacent to the magnetic brush between the developing tank and the photoconductive member in a direction of rotation of the magnetic brush; and a voltage source for applying an electric potential between the magnetic brush and the electrode for controlling an amount of transfer of toner substance therebetween, the voltage source comprising control means for controlling an amount of transfer of toner substance from the magnetic brush to the electrode when the developing unit is being used for developing a toner image on the photoconductive member and thereby a density of the toner image.

8. A copying machine as in claim 7, further comprising toner supply means for continuously feeding fresh toner substance into the developing tank, the supply means including mixing means for removing toner substance from the magnetic brush and mixing the same with the fresh toner substance.

9. A copying machine as in claim 8, in which the supply means is disposed adjacent to the magnetic brush between the photoconductive member and the magnetic brush in the direction of rotation of the photoconductive member.

10. A copying machine as in claim 9, in which the mixing means comprises a hopper containing the fresh toner substance and being formed with a supply orifice above the developing tank, a rotary cylinder disposed below the supply orifice in such a manner that the fresh toner substance falls onto the rotary cylinder and falls from the rotary cylinder into the developing tank and a doctor member disposed closely adjacent to the magnetic brush for removing toner substance therefrom, the doctor member being shaped to convey the toner substance removed thereby from the magnetic brush onto the rotary cylinder to be mixed with the fresh toner substance thereon.

11. A copying machine as in claim 10, in wich the rotary cylinder is magnetic.

12. An electrostatic copying machine comprising:

a rotary photoconductive member;

a magnetic brush developing unit including a rotary magnetic brush operatively disposed adjacent to the photoconductive member and a developing tank containing a toner substance in which the magnetic brush is partially immersed;

an electrode disposed closely adjacent to the magnetic brush between the developing tank and the photoconductive member in a direction of rotation of the magnetic brush;

a voltage source for applying an electric potential between the magnetic brush and the electrode for controlling an amount of transfer of toner substance therebetween;

the developing unit bifunctioning to clean the photoconductive member, the voltage source being constructed to vary the electric potential in such a manner that toner substance is transferred from the magnetic brush to the electrode only when the developing unit is being used to clean the photoconductive member and that toner substance is transferred from the electrode to the magnetic brush only when the developing unit is being used for developing a toner image on the photoconductive member; and an auxiliary electrode disposed closely adjacent to said electrode, the voltage source being further connected to the auxiliary electrode and constructed to adjustingly apply an electric potential to the auxiliary electrode in such a manner that toner substance is transferred from the magnetic brush to said electrode and from said electrode to the auxiliary electrode when the developing unit is being used to clean the photoconductive member and toner substance is transferred from the auxiliary electrode to said electrode and from said electrode to the magnetic brush when the developing unit is being used for developing a toner image on the photoconductive member.

13. A copying machine as in claim 12, in which said electrode and the auxiliary electrode comprise rotary cylinders respectively.

* * * * *